US008562118B2

(12) United States Patent
Tamaki

(10) Patent No.: US 8,562,118 B2
(45) Date of Patent: Oct. 22, 2013

(54) LIQUID EJECTING APPARATUS

(75) Inventor: Shuichi Tamaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 375 days.

(21) Appl. No.: 12/722,004

(22) Filed: Mar. 11, 2010

(65) Prior Publication Data

US 2010/0321424 A1 Dec. 23, 2010

(30) Foreign Application Priority Data

Jun. 22, 2009 (JP) ..... 2009-147234

(51) Int. Cl.

| | |
|---|---|
| ***B41J 2/18*** | (2006.01) |
| ***B41J 29/38*** | (2006.01) |
| ***B41J 2/05*** | (2006.01) |
| ***B41J 2/175*** | (2006.01) |

(52) U.S. Cl.

USPC ..... 347/89; 347/6; 347/65; 347/85

(58) Field of Classification Search

CPC ..... B41J 2/175; B41J 2/17596; B41J 2/1404; B41J 2/1631; B41J 2/17513; B41J 2/18

See application file for complete search history.

(56) References Cited

U.S. PATENT DOCUMENTS

| | | | | |
|---|---|---|---|---|
| 5,784,085 | A * | 7/1998 | Hosono et al. | 347/70 |
| 6,000,792 | A * | 12/1999 | Koizumi et al. | 347/89 |
| 6,179,406 | B1 * | 1/2001 | Ito et al. | 347/35 |
| 6,213,601 | B1 * | 4/2001 | Akuzawa et al. | 347/89 |
| 6,234,597 | B1 * | 5/2001 | Suzuki et al. | 347/7 |
| 6,491,365 | B2 * | 12/2002 | Sonobe | 347/22 |
| 7,533,975 | B2 | 5/2009 | Koga et al. | |

(Continued)

FOREIGN PATENT DOCUMENTS

| | | | |
|---|---|---|---|
| EP | 0 903 235 | A2 | 3/1999 |
| EP | 931662 | A2 * | 7/1999 |

(Continued)

OTHER PUBLICATIONS

Notification of Reasons for Refusal dated Jun. 7, 2011 received from the Japanese Patent Office from related Japanese Application No. 2009-147234, together with an English-language translation.

(Continued)

*Primary Examiner* — Stephen Meier
*Assistant Examiner* — Leonard S Liang
(74) *Attorney, Agent, or Firm* — Scully Scott Murphy & Presser PC

(57) ABSTRACT

A liquid ejecting apparatus, including: a tank for storing a liquid; a liquid ejecting head that includes an inner passage having an inlet and an outlet and individual liquid channels; a supply passage connecting the tank and the inlet; a return passage connecting the tank and the outlet; a supply device to forcibly supply the liquid in the tank to the inner passage; a restrictor valve to restrict a liquid amount flowing through the return passage; and a discharge controller to drive the supply device while opening the restrictor valve, such that liquid circulation is conducted in which the liquid in the tank returns back thereto via the supply passage, the inner passage, and the return passage, in order, and configured to control the valve to restrict, during the liquid circulation, the liquid amount flowing through the return passage, for permitting a discharge of the liquid from the ejection openings.

16 Claims, 12 Drawing Sheets

(56) References Cited

U.S. PATENT DOCUMENTS

| | | | | |
|---|---|---|---|---|
| 7,594,717 | B2 * | 9/2009 | Sheinman | 347/89 |
| 7,862,142 | B2 | 1/2011 | Taira | |
| 8,100,519 | B2 * | 1/2012 | Hirashima | 347/89 |
| 2002/0093546 | A1 * | 7/2002 | Johnson | 347/35 |
| 2002/0196318 | A1 * | 12/2002 | Shimizu | 347/85 |
| 2005/0212874 | A1 * | 9/2005 | Nomura et al. | 347/84 |
| 2006/0103700 | A1 | 5/2006 | Taira | |
| 2006/0132554 | A1 | 6/2006 | Ota et al. | |
| 2006/0139419 | A1 * | 6/2006 | Shigemura | 347/85 |
| 2007/0035593 | A1 * | 2/2007 | Iwasaki et al. | 347/85 |
| 2007/0120912 | A1 | 5/2007 | Lim et al. | |
| 2007/0206063 | A1 * | 9/2007 | Mukai et al. | 347/61 |
| 2008/0239013 | A1 | 10/2008 | Hirashima | |
| 2008/0273064 | A1 | 11/2008 | Ota et al. | |
| 2008/0297546 | A1 * | 12/2008 | Lee et al. | 347/6 |
| 2009/0002467 | A1 | 1/2009 | Watanabe | |
| 2009/0009569 | A1 * | 1/2009 | Sasaki | 347/85 |
| 2010/0021635 | A1 * | 1/2010 | Ookawa et al. | 427/256 |

FOREIGN PATENT DOCUMENTS

| | | | |
|---|---|---|---|
| JP | A-4-255361 | | 9/1992 |
| JP | A-5-220972 | | 8/1993 |
| JP | A-8-276604 | | 10/1996 |
| JP | 10129008 | A * | 5/1998 |
| JP | 11091124 | A * | 4/1999 |
| JP | 11091127 | A * | 4/1999 |
| JP | 11091137 | A * | 4/1999 |
| JP | 11-129502 | A | 5/1999 |
| JP | 2006-068904 | | 3/2006 |
| JP | A-2006-88575 | | 4/2006 |
| JP | A-2006-159811 | | 6/2006 |
| JP | A-2006-168339 | | 6/2006 |
| JP | A-2008-55646 | | 3/2008 |
| JP | 2008-246843 | | 10/2008 |
| JP | 2009-29111 | | 2/2009 |

OTHER PUBLICATIONS

Extended European Search Report dated Nov. 10, 2010.

Decision of Refusal dated Sep. 25, 2012 received from the Japanese Patent Office from related Japanese Application No. 2009-147234, together with an English-language translation.

* cited by examiner

LIQUID EJECTING APPARATUS

CROSS REFERENCE TO RELATED APPLICATION

The present application claims priority from Japanese Patent Application No. 2009-147234, which was filed on Jun. 22, 2009, the disclosure of which is herein incorporated by reference in its entirety.

BACKGROUND OF THE INVENTION

1. Field of the Invention

The present invention relates to a liquid ejecting apparatus configured to eject a liquid from ejection openings.

2. Discussion of Related Art

In an ink-jet head configured to eject ink droplets from its ejection openings, there is known a technique of forcibly discharging, from the ejection openings, the air and foreign substances together with ink, by forcibly supplying ink into an ink passage of the head using a pump, for the purpose of discharging the air and the foreign substances remaining in the ink passage. According to the technique, the ink is pressurized for a predetermined time by activating a supply pump after a discharge passage has been blocked, and the ink is ejected from nozzles, thereby conducting cleaning of the nozzles.

SUMMARY OF THE INVENTION

In order to discharge the air and the foreign substances from the ejection openings with high reliability, it is needed to increase the pressure of the ink in the ink passage by increasing a flow rate of the ink, i.e., an amount of the ink that is supplied to the ink passage per unit time. It takes, however, a certain time for the ink pressure in the ink passage to reach a desired pressure after the pump has been started to be driven. Accordingly, it is inevitable that the ink is wastefully discharged from the ejection openings until the ink pressure reaches the desired pressure.

It is therefore an object of the invention to provide a liquid ejecting apparatus capable of suppressing wasteful consumption of a liquid while enabling the air and foreign substances to be efficiently discharged from ejection openings, together with the liquid.

The above-indicated object may be attained according to a principle of the invention, which provides a liquid ejecting apparatus, comprising:

a tank for storing a liquid;

a liquid ejecting head including: an inner passage having an inlet and an outlet; and a plurality of individual liquid channels extending from the inner passage to respective ejection openings;

a supply passage which connects the tank and the inlet;

a return passage which connects the tank and the outlet;

a supply device configured to forcibly supply the liquid in the tank to the inner passage;

a restrictor valve configured to restrict an amount of the liquid that flows through the return passage; and a discharge controller configured to drive the supply device while placing the restrictor valve in an open state, such that liquid circulation is conducted in which the liquid in the tank returns back thereto via the supply passage, the inner passage, and the return passage, in order, and configured to control the restrictor valve to restrict, during the liquid circulation, the amount of the liquid that flows through the return passage, for permitting a discharge of the liquid from the ejection openings.

BRIEF DESCRIPTION OF THE DRAWINGS

The above and other objects, features, advantages and technical and industrial significance of the present invention will be better understood by reading the following detailed description of embodiments of the invention, when considered in connection with the accompanying drawings, in which.

DETAILED DESCRIPTION OF THE EMBODIMENTS

There will be hereinafter described embodiments of the invention with reference to the drawings.

Figure 1:
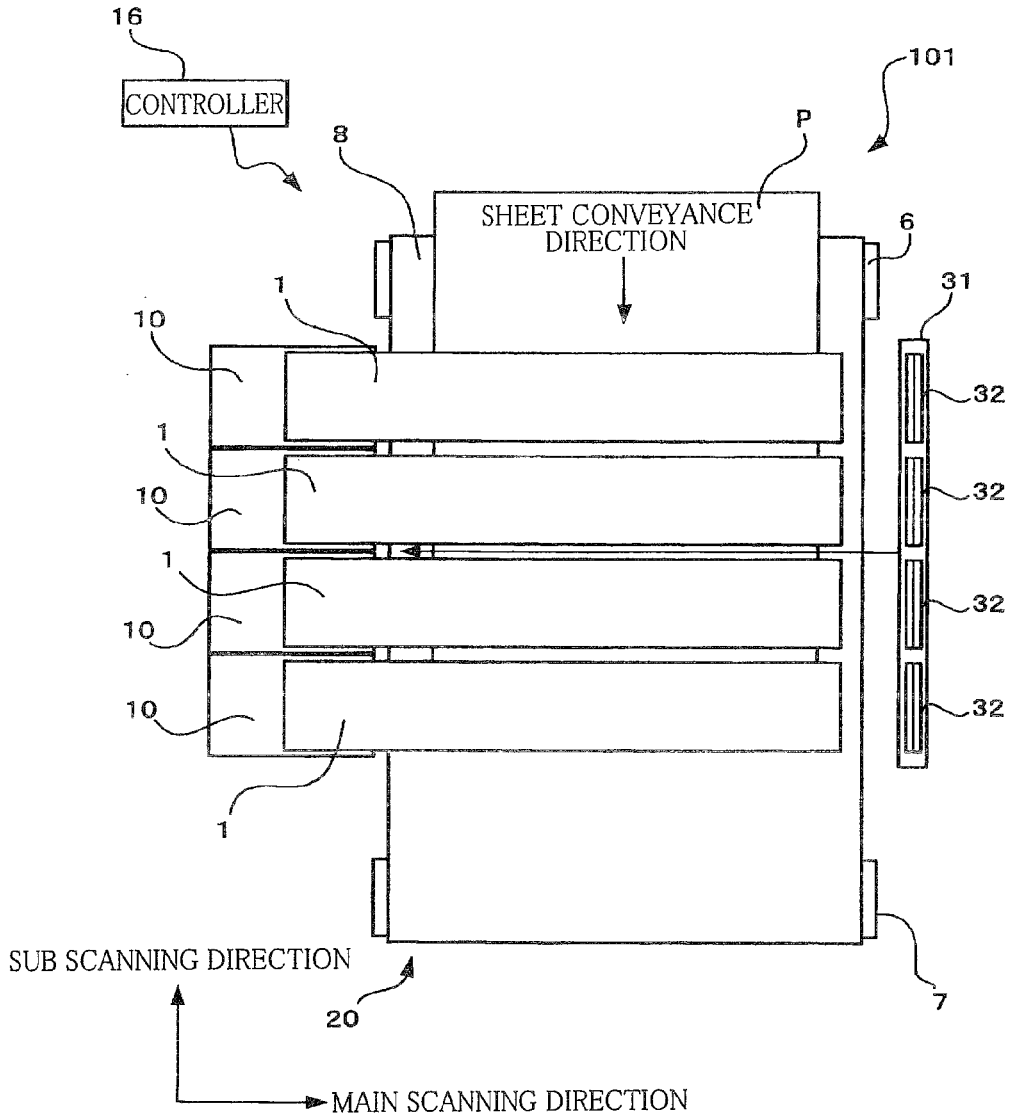
FIG. 1 is a plan view schematically showing an ink-jet printer according to one embodiment of the invention.

As shown in FIG. 1, an ink-jet printer 101 as a liquid ejecting apparatus according to one embodiment of the invention has a conveyor unit 20 for conveying a sheet P in a direction from the upper side to the lower side in FIG. 1, four ink-jet heads 1 for ejecting droplets of a magenta ink, a cyan ink, a yellow ink, and a black ink, respectively, on the sheet P conveyed by the conveyor unit 20, four ink supply units 10 for supplying the inks to the respective ink-jet heads 1, a maintenance unit 31 for performing maintenance of the ink-jet heads 1, and a controller 16 for controlling the ink-jet printer 101 as a whole. In the present embodiment, a sub scanning direction is a direction parallel to a sheet conveyance direction in which the sheet P is conveyed by the conveyor unit 20 while a main scanning direction is a direction that is horizontal and is perpendicular to the sub scanning direction.

The conveyor unit 20 includes two belt rollers 6, 7 and an endless conveyor belt 8 wound around the two rollers 6, 7 so as to be stretched therebetween. The belt roller 7 is a drive roller configured to rotate by a drive force transmitted from a conveyance motor not shown. The belt roller 6 is a driven roller configured to rotate by the movement of the conveyor belt 8 in accordance with the rotation of the belt roller 7. The sheet P placed on an outer surface of the conveyor belt 8 is conveyed in a downward direction as seen in FIG. 1.

Each of the four ink-jet heads 1 extends in the main scanning direction. The four ink-jet heads 1 are arranged in the sub scanning direction so as to be parallel with each other. That is, the ink-jet printer 101 is a line-type color ink-jet printer wherein a plurality of ejection openings 108 from which ink droplets are ejected are arranged in the main scanning direction. The lower surface of each ink-jet head 1 is formed as an ejection surface 2*a* shown in FIG. 2 in which the plurality of ejection openings 108 are arranged.

The outer surface of the upper loop portion of the conveyor belt 8 is opposed to the ejection surfaces 2*a* so as to be parallel to the ejection surfaces 2*a*. When the sheet P conveyed by the conveyor belt 8 passes right below the four ink-jet heads 1, the ink droplets of the mutually different colors are ejected in order from the respective ink-jet heads 1 to the upper surface of the sheet P, so that a desired color image is formed on the sheet P.

Each ink supply unit 10 is connected to the vicinity of the left-side end portion of the lower surface of the corresponding ink-jet head 1 as seen in FIG. 1, so as to supply the ink to the ink-jet head 1 connected thereto.

The maintenance unit 31 includes four wipers 32 each of which is an elastic member for wiping the ejection surface 2*a* of the corresponding ink-jet head 1 in a wiping operation relating to a maintenance operation that will be explained below. The wipers 32 are configured to be reciprocatingly movable in the main scanning direction by a suitable moving device.

Figure 2:
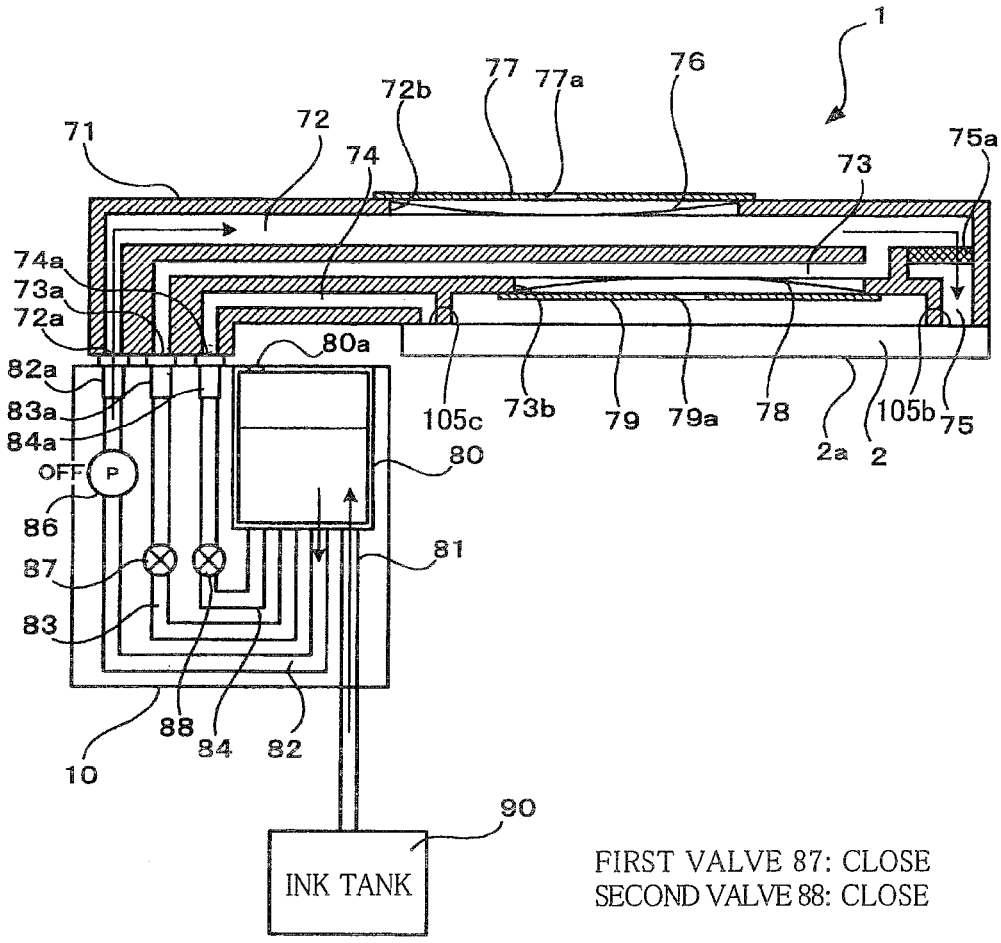
FIG. 2 is a cross sectional view of an ink-jet head and an ink supply unit shown in FIG. 1.

Referring next to FIG. 2, each ink-jet head 1 will be explained in detail. As shown in FIG. 2, each ink-jet head 1 includes a reservoir unit 71 and a head main body 2.

The reservoir unit 71 is fixed to the upper surface of the head main body 2 and is a flow-passage forming member through which the ink is supplied to the head main body 2. There are formed, in the reservoir unit 71, an ink inflow passage 72 as a part of a reservoir passage, ten ink outflow passages 75, a first discharge passage 73 as a part of the reservoir passage, and a second discharge passage 74 as a part of a common liquid passage. In FIG. 2, only one of the ten ink outflow passages 75 is shown.

The ink inflow passage 72 is a passage into which the ink flows from the ink supply unit 10 via an inlet 72*a* that is open to the lower surface of the reservoir unit 71. The ink inflow passage 72 functions as an ink reservoir for temporarily storing the ink that flows thereinto. On the upper-side inner wall surface of the ink inflow passage 72, there is formed an opening 72*b* that penetrates through the upper outer wall of the reservoir unit 71. A resin film 76 having flexibility closes the opening 72*b* from the upper side of the reservoir unit 71 and constitutes a part of the inner wall surface of the ink inflow passage 72. The resin film 76 deforms in accordance with a change or fluctuation of the ink pressure in the ink inflow passage 72 and gives, to the ink inflow passage 72, a damper function for restraining the change or fluctuation of the ink pressure. More specifically, the deformation of the resin film 76 restrains the change or fluctuation of the ink pressure in the ink inflow passage 72. Accordingly, the ink can be supplied to individual ink channels (which will be described) while being kept at a stable pressure each time when the ink droplets are ejected from the ejection openings 108. The damper function can be realized at a low cost by utilizing the resin film 76. In a normal printing operation, the resin film 76 is kept in a state in which the resin film 76 slightly protrudes convexly toward the inside of the ink inflow passage 72. A plate-like limiting member 77 is fixed to the upper outer wall of the reservoir unit 71 so as to cover the resin film 76. The limiting member 77 prevents the resin film 76 from protruding convexly toward the outside of the reservoir unit 71. According to the arrangement, the resin film 76 is prevented from being broken due to its excessive deformation when the ink pressure in the ink inflow passage 72 becomes abnormally high. The limiting member 77 is formed with a communication hole 77*a*, whereby a space enclosed by the limiting member 77 and the resin film 76 is kept at the atmospheric pressure. Accordingly, the resin film 76 can be easily deformed.

Each ink outflow passage 75 is held in communication with the ink inflow passage 72 via a filter 75*a* and is held in communication with a corresponding one of ink supply holes 105*b* (FIG. 3) formed on an upper surface of a flow-passage unit 9 (FIG. 3) of the head main body 2. The filter 75*a* extends in a direction in which the ink flows in the ink inflow passage 72. In the normal printing operation, the ink from the ink supply unit 10 initially flows into the ink inflow passage 72, subsequently passes through the ink outflow passages 75, and finally flows into the flow-passage unit 9 via the ink supply holes 105*b*.

Figure 8A:
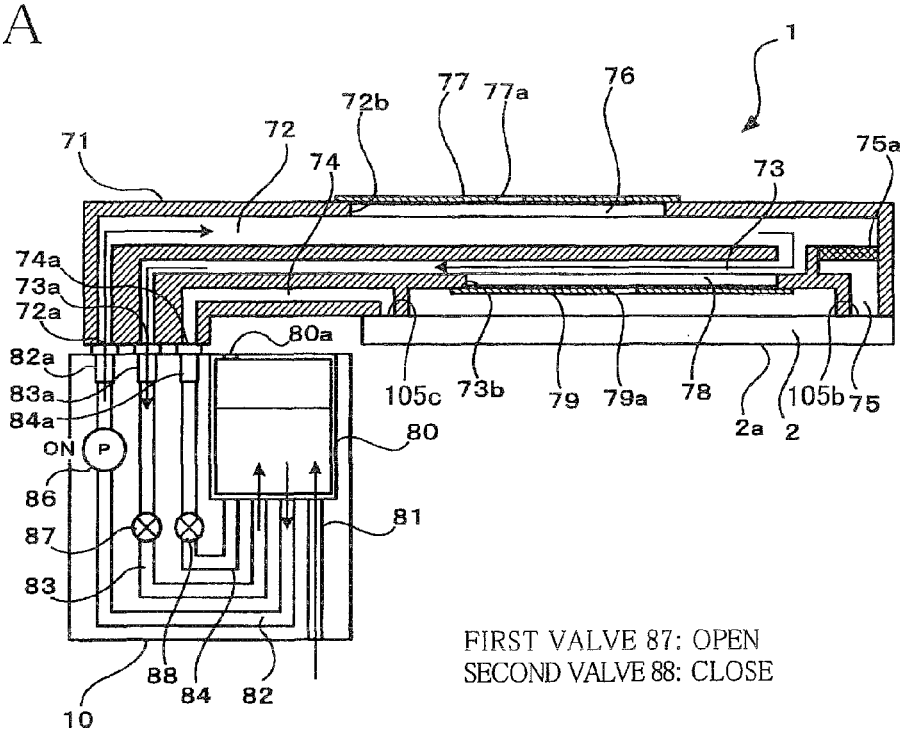
FIGS. 8A and 8B are views each showing a flow of ink when ink circulation is conducted by a purging control portion shown in FIG. 6.

The first discharge passage 73 is held in communication with the ink inflow passage 72 on the upstream side of the filter 75*a* and is connected to the ink supply unit 10 via a first outlet 73*a* formed on the lower surface of the reservoir unit 71. On the lower-side inner wall surface of the first discharge passage 73, there is formed an opening 73*b* that penetrates through the lower outer wall of the reservoir unit 71. A resin film 78 having flexibility closes the opening 73*b* from the lower side of the reservoir unit 71 and constitutes a part of the inner wall surface of the first discharge passage 73. The resin film 78 deforms in accordance with a change or fluctuation of the ink pressure in the first discharge passage 73 and gives, to the first discharge passage 73, a damper function for restraining the change or fluctuation of the ink pressure, as described above with respect to the resin film 76. The damper function can be realized at a low cost by utilizing the resin film 78. In the normal printing operation, the resin film 78 is kept in a state in which the resin film 78 slightly protrudes convexly toward the inside of the first discharge passage 73. A plate-like limiting member 79 is fixed to the lower outer wall of the reservoir unit 71 so as to cover the resin film 78. The limiting member 79 prevents the resin film 78 from protruding convexly toward the outside of the reservoir unit 71. According to the arrangement, the resin film 78 is prevented from being broken due to its excessive deformation when the ink pressure in the first discharge passage 73 becomes abnormally high. The limiting member 79 is formed with a communication hole 79*a*, whereby a space enclosed by the limiting member 79 and the resin film 78 is kept at the atmospheric pressure. Accordingly, the resin film 78 can be easily deformed. In first ink circulation as liquid circulation that will be explained below, the ink from the ink supply unit 10 initially flows into the ink inflow passage 72 via the inlet 72*a*, subsequently passes through the first discharge passage 73, and finally returns back into the ink supply unit 10 via the first outlet 73*a*, as shown in FIG. 8A.

Figure 8B:
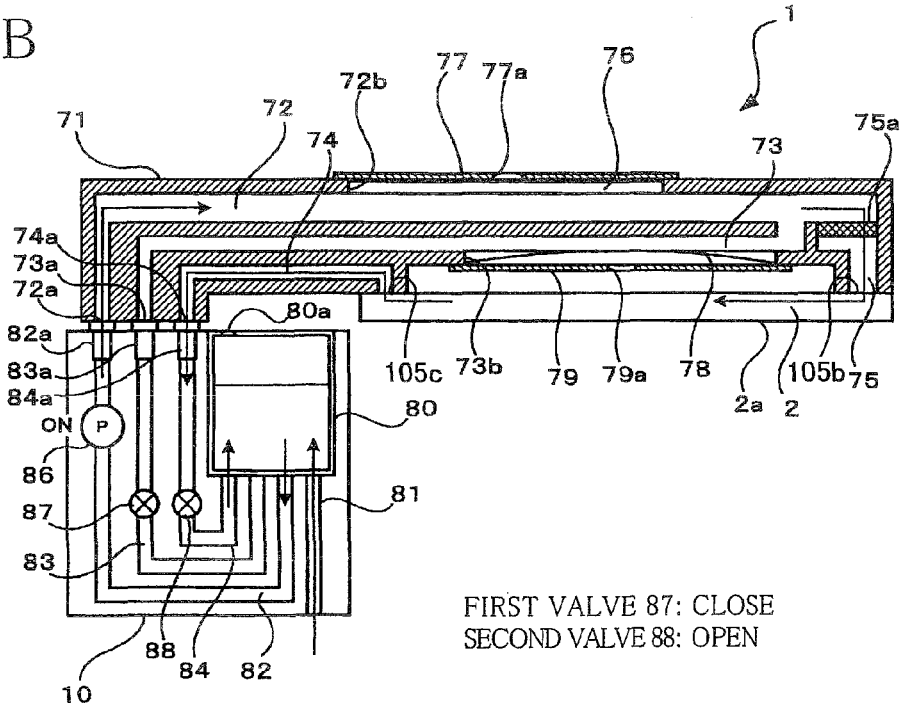

The second discharge passage 74 is held in communication with the flow-passage unit 9 and is connected to the ink supply unit 10 via a second inlet 74*a* formed on the lower surface of the reservoir unit 71. In second ink circulation as the liquid circulation that will be explained below, the ink from the ink supply unit 10 initially flows into the ink inflow passage 72 via the inlet 72*a*, subsequently passes through the ink outflow passages 75, manifolds 105 of the flow-passage unit 9, and the second discharge passage 74, and finally returns back into the ink supply unit 10 via the second outlet 74*a*, as shown in FIG. 8B.

The head main body 2 will be next explained with reference to FIGS. 3 and 4. In FIG. 4, pressure chambers 110, apertures 112, and the ejection openings 108 which are located below actuator units 21 and which should be therefore illustrated by a broken line are illustrated by a solid line for the sake of convenience.

Figure 3:
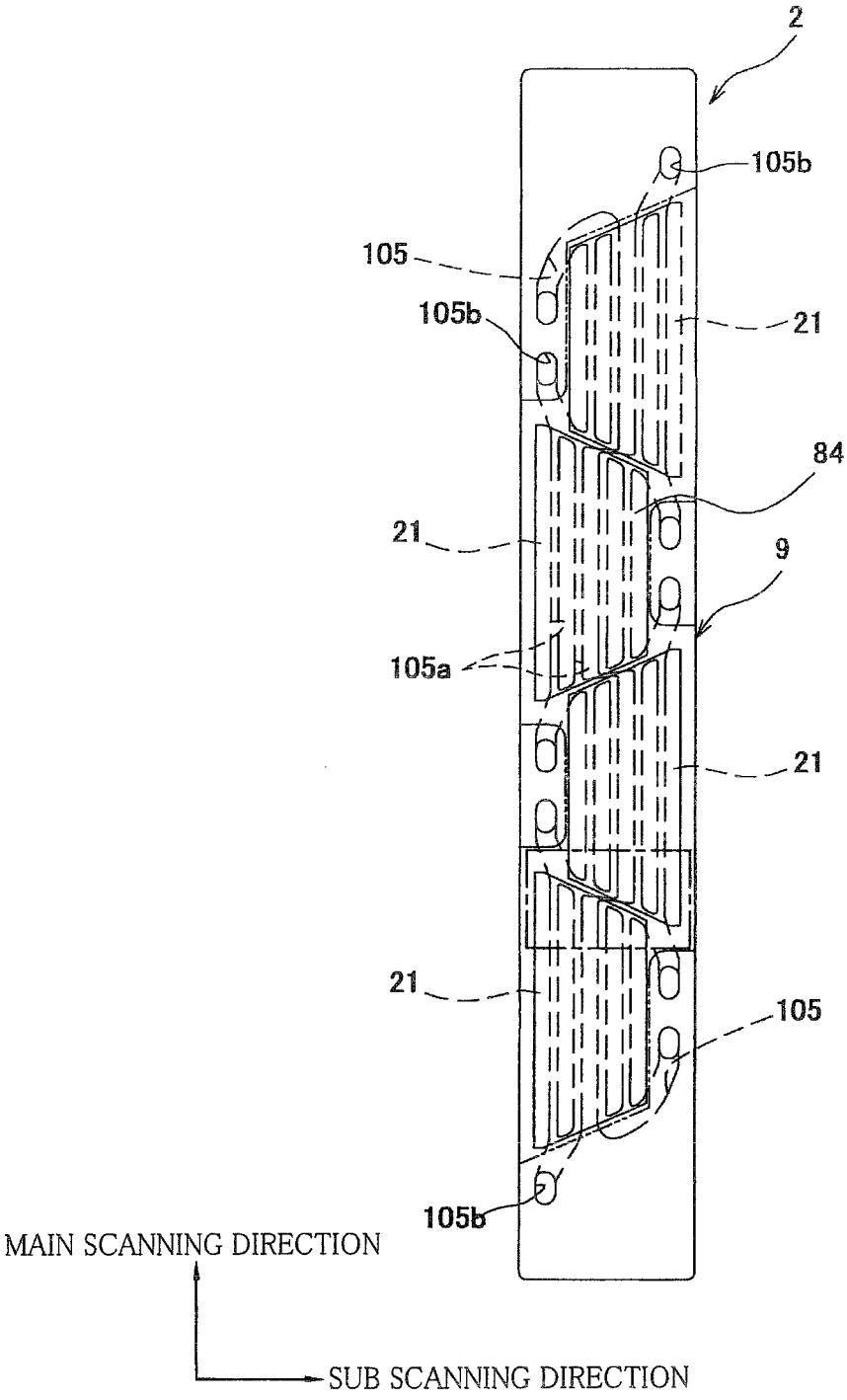
FIG. 3 is a plan view of a head body shown in FIG. 2.
Figure 4:
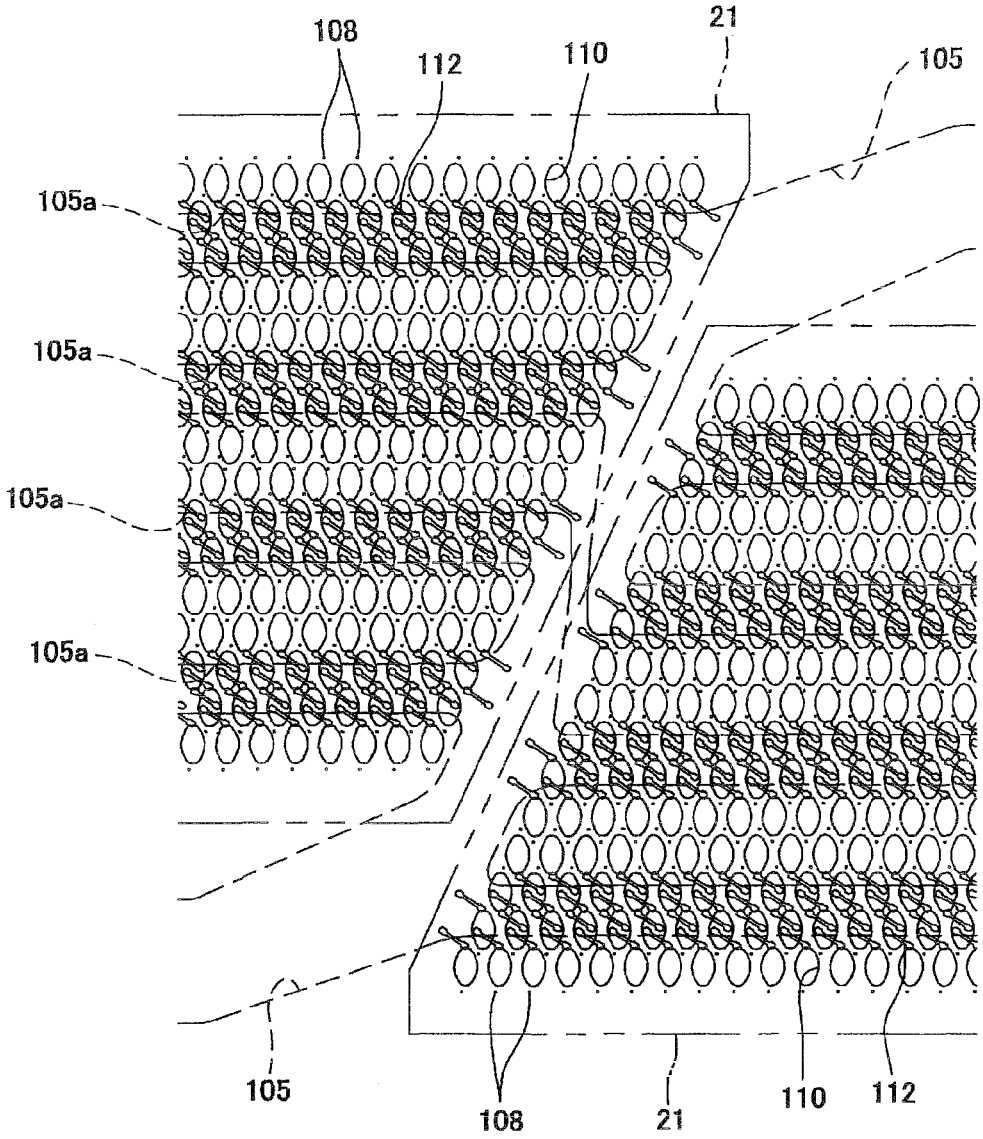
FIG. 4 is an enlarged view of a region enclosed by one-dot chain line in FIG. 3.

As shown in FIGS. 3 and 4, the head body 2 is formed of a stacked body including the flow-passage unit 9 and four actuator units 21 fixed to the upper surface of the flow-passage unit 9. There are formed, in the flow-passage unit 9, ink passages including the pressure chambers, and so on. Each actuator unit 21 includes a plurality of unimorph actuators corresponding to the respective pressure chambers 110 and has a function of giving ejection energy selectively to the ink in the pressure chambers 110.

The flow-passage unit 9 has a stacked structure including a plurality of metal plates, each formed of stainless steel, which are superposed while being positioned relative to each other. The ten ink supply holes 105 communicating with the respective ink outflow passages 75 (FIG. 2) of the reservoir unit 71 and a discharge hole 105*c* communicating with the second discharge passage 74 of the reservoir unit 71 are open to the upper surface of the flow-passage unit 9. As shown in FIG. 3, there are formed, in the flow-passage unit 9, the manifolds 105 each communicating with the corresponding ink supply hole 105*b* and the discharge hole 105*c*, and a multiplicity of individual ink channels branched from sub manifolds 105*a* of each manifold 105. A multiplicity of ejection openings 108 are arranged in a matrix on the ejection surfaces 2*a*.

There will be next explained a flow of the ink in the flow-passage unit 9 with reference to FIGS. 3 and 4. In the normal printing operation, the ink supplied from the ink outflow passages 75 of the reservoir unit 71 to the ink supply holes 105*b* is distributed into the sub manifolds 105*a* of the manifolds 105. The ink in the sub manifolds 105*a* flows into the individual ink channels and reaches the ejection openings 108 via the respective pressure chambers 110. As shown in FIG. 8B, in the second ink circulation explained below, the ink supplied from the ink outflow passages 75 of the reservoir unit 71 to the ink supply holes 105*b* passes through the manifolds 105 and flows into the second discharge passage 74 of the reservoir unit 71 via the discharge hole 105*c* formed at a suitable position of the reservoir unit 71.

The ink supply unit 10 will be explained in detail. As shown in FIG. 2, the ink supply unit 10 includes a sub tank 80, an ink replenish tube 81 connected to the sub tank 80, an ink supply tube 82 as a supply passage, a first ink return tube 83 and a second ink return tube 84 each as a return passage, a purge pump 86 provided for the ink supply tube 82, a first valve 87 provided for the first ink return tube 83, and a second valve 88 provided for the second ink return tube 84.

The sub tank 80 stores the ink to be supplied to the corresponding ink-jet head 1. The ink stored in the ink tank 90 is supplied to the sub tank 80 through the ink replenish tube 81 for replenishment of the sub tank 80. A communication hole 80*a* is formed through the outer wall of the sub tank 80, whereby the pressure in the sub tank 80 is kept at the atmospheric pressure irrespective of the amount of the ink stored therein, enabling the ink to be supplied with high stability.

Figure 5:
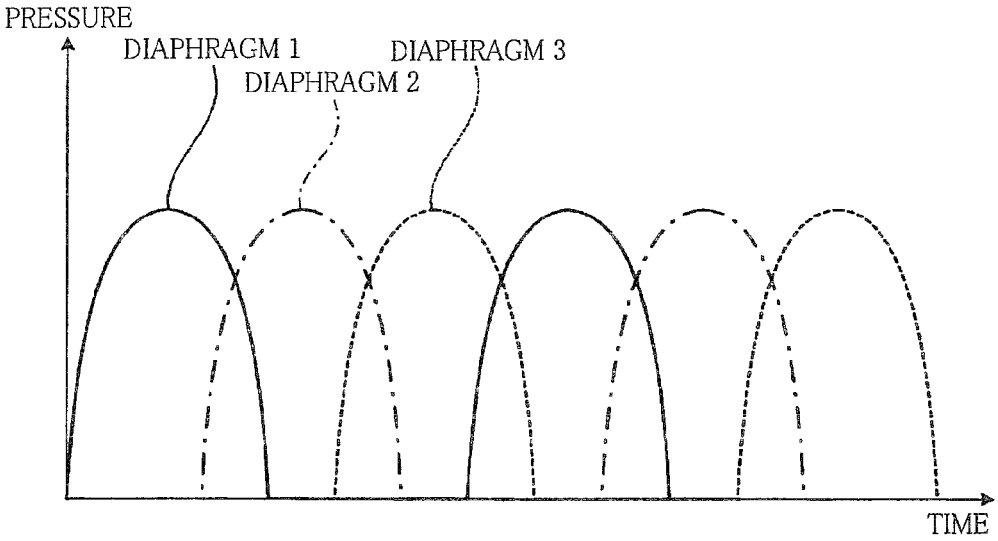
FIG. 5 is a graph showing operational characteristics of a purge pump shown in FIG. 2.

The ink supply tube 82 is connected at one end thereof to the sub tank 80 and at the other end thereof to the inlet 72*a* of the reservoir unit 71 via a joint 82*a*. Accordingly, the ink in the sub tank 80 is supplied into the ink inflow passage 72 of the reservoir unit 71 through the ink supply tube 82. The purge pump 86 is configured to forcibly supply, by being driven, the ink in the sub tank 80 into the ink inflow passage 72 through the ink supply tube 82. Thus, the purge pump 86 functions as a supply device. Further, the purge pump 86 is configured to prevent the ink from flowing, in the ink supply tube 82, in a direction from the joint 82*a* to the sub tank 80. Thus, the purge pump 86 functions as a check valve that is one kind of a backflow preventing device. The purge pump 86 is a three-phase diaphragm pump that is a positive displacement pump, in which three diaphragms are driven in mutually different phases as shown in FIG. 5, thereby restraining a pressure change or fluctuation that is to be caused when the ink is supplied. Accordingly, even where the pressure in the flow passages is high, a desired volume of the ink can be supplied with high reliability.

As shown in FIG. 2, the first return tube 83 is connected at one end thereof to the sub tank 80 and at the other end thereof to the first outlet 73*a* of the reservoir unit 71 via a joint 83*a*. The first valve 87 functions as a restrictor valve for restricting an amount of the ink that flows through the first return tube 83.

As shown in FIG. 2, the second return tube 84 is connected at one end thereof to the sub tank 80 and at the other end thereof to the second outlet 74*a* of the reservoir unit 71 via a joint 84*a*. The second valve 84 functions as a restrictor valve for restricting an amount of the ink that flows through the second return tube 84.

Figure 6:
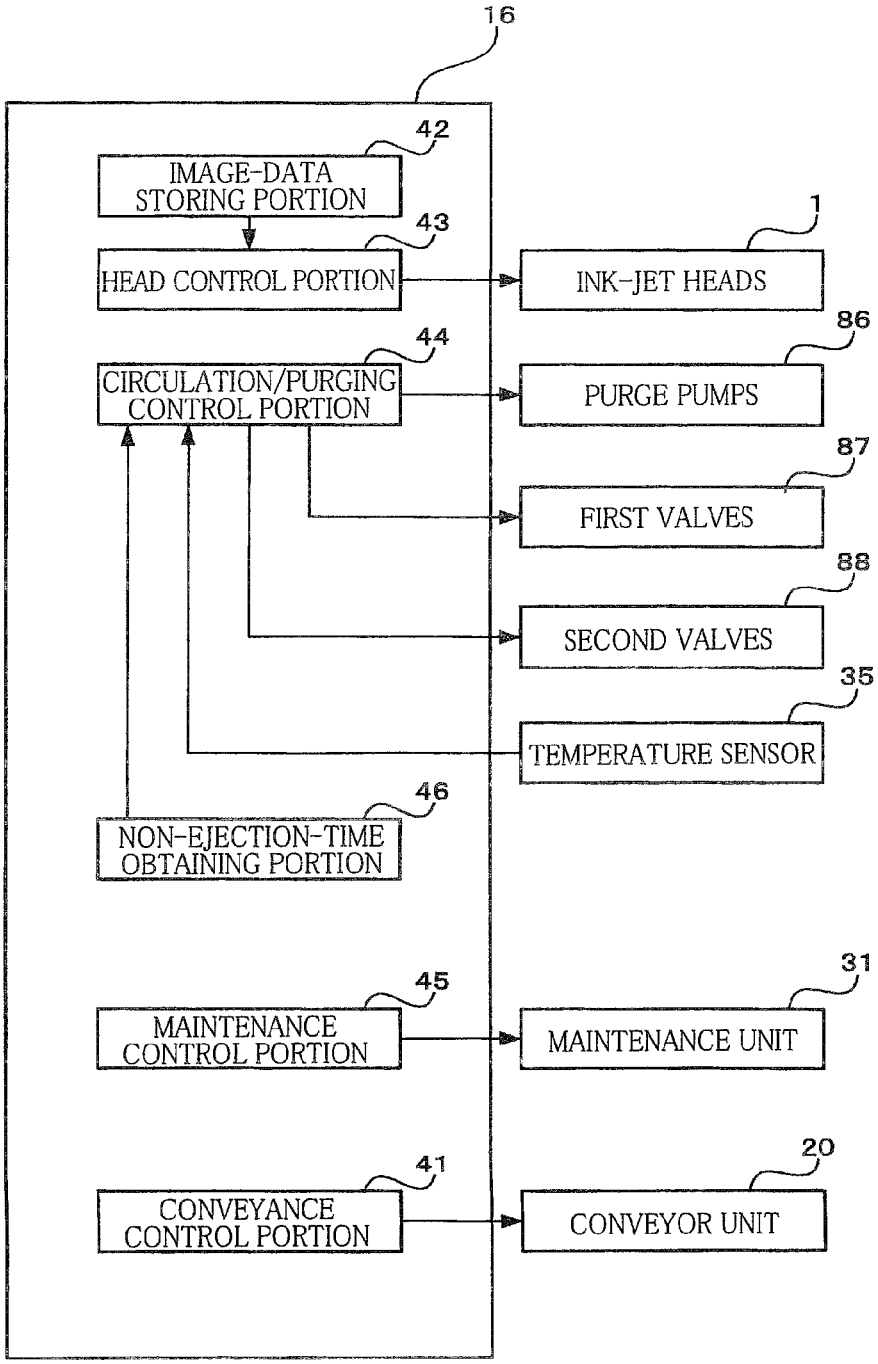
FIG. 6 is a functional block diagram of a controller shown in FIG. 1.

Referring next to FIG. 6, the controller 16 will be explained. The controller 16 includes a Central Processing Unit (CPU), an Electrically Erasable and Programmable Read Only Memory (EEPROM) storing programs to be executed by the CPU and rewritably storing data to be utilized in the programs, and a Random Access Memory (RAM) temporarily storing data when the programs are executed. Various functional portions that constitute the controller 16 are established by a combination of hardware described above and software in the EEPROM. The controller 16 controls the ink-jet printer 101 as a whole and includes a conveyance control portion 41, an image-data storing portion 42, a head control portion 43, a non-ejection-time obtaining portion 46 as a non-ejection-time obtainer, a circulation/purging control portion 44, and a maintenance control portion 45.

The conveyance control portion 41 is configured to control the conveyance motor of the conveyor unit 20 so as to convey the sheet P in the sheet conveyance direction.

The image-data storing portion 42 stores image data relating to an image to be printed on the sheet P.

Figure 7A:
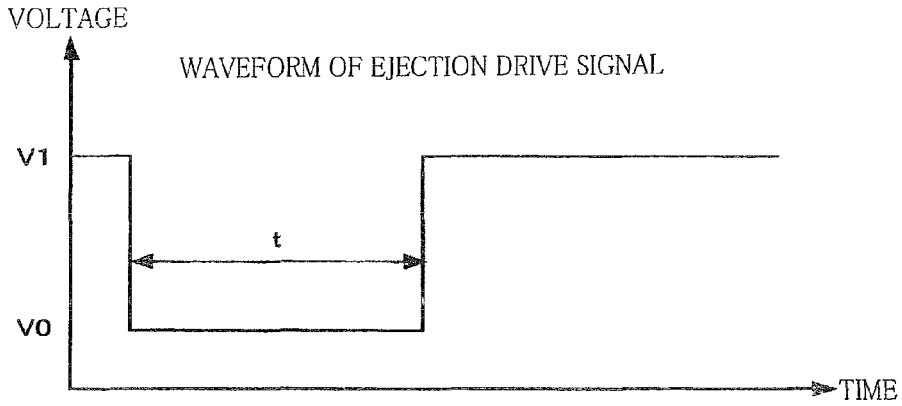
FIG. 7A is a view showing a waveform of an ejection drive signal generated by a head control portion shown in FIG. 6

The head control portion 43 is configured to send, in the printing operation, an ejection drive signal generated based on the image data, to the actuator units 21. As shown in FIG. 7A, the ejection drive signal includes, in one printing period, at least one pulse whose potential is maintained, for a prescribed time, at a ground potential V0 that is lowered from a potential V1. The width t of the pulse is equal to a time in which a pressure wave propagates over a distance AL (Acoustic Length) from the exit of the sub manifold 105*a* to the corresponding ejection openings 108. It is noted that the waveform shown in FIG. 7A is for ejecting a small-size ink droplet and includes one pulse. A waveform for ejecting a medium-size ink droplet includes two pulses while a waveform for ejecting a large-size ink droplet includes three pulses.

Figure 7B:
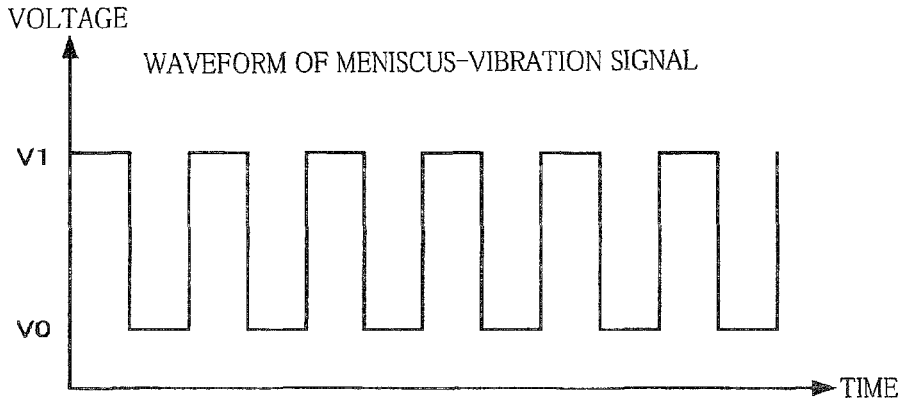
FIG. 7B is a view showing a waveform of a meniscus-vibration signal generated by the head control portion shown in FIG. 6.

The head control portion 43 is configured to send, in the first and second circulation operations that will be explained, a meniscus-vibration signal for vibrating meniscuses of the ink formed at all of the ejection openings 108, to the actuator units 21. According to the arrangement, the ink meniscus formed at each ejection openings 108 is vibrated, whereby a breakdown pressure of the ink meniscus (i.e., an ink-meniscus breakdown pressure) at each ejection opening 108 is increased. Thus, the head control portion 43 functions as a meniscus-vibration controller, and each of the actuator units 21 functions as a vibration-energy giving device. As shown in FIG. 7B, the meniscus-vibration signal is a signal in which is repeated at a prescribed cycle a pulse whose potential is maintained, for a prescribed time, at the ground potential V0 that is lowered from the potential V1. The width of the pulse is preferably not larger than one third of the time of propagation of the pressure wave over the distance AL.

The non-ejection-time obtaining portion 46 is configured to obtain, for each ink-jet head 1, a non-ejection time during which the ink droplets have not been ejected from all of the ejection openings 108, on the basis of previous ejection history.

The circulation/purging control portion 44 as a discharge controller is configured to control, in the maintenance operation that will be explained, operations of the purge pump 86, the first valve 87, and the second valve 88 of each ink supply unit 10. The operations will be specifically explained later.

The maintenance control portion 45 is configured to control, in the maintenance operation, an operation of the maintenance unit 31.

Figure 9:
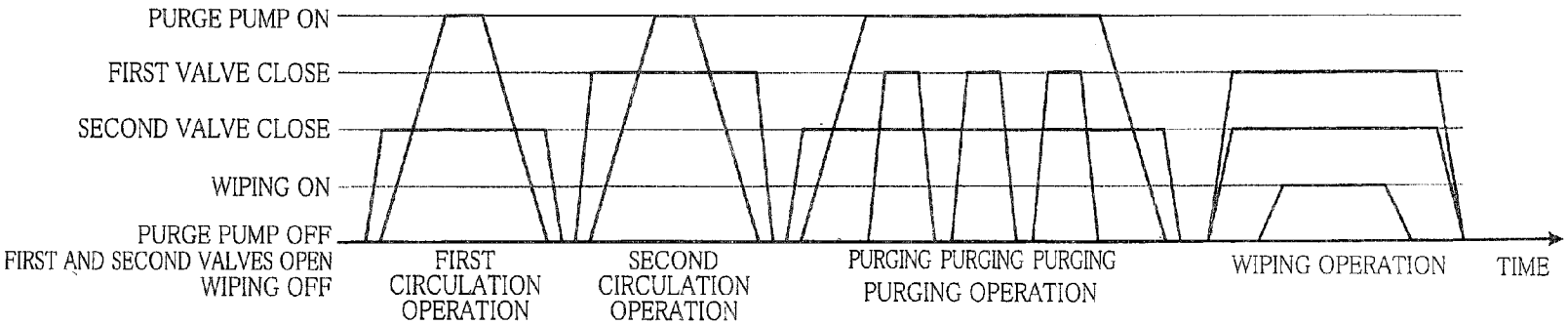
FIG. 9 is a view showing a sequence of a maintenance operation by the purging control portion shown in FIG. 6.
Figure 10:
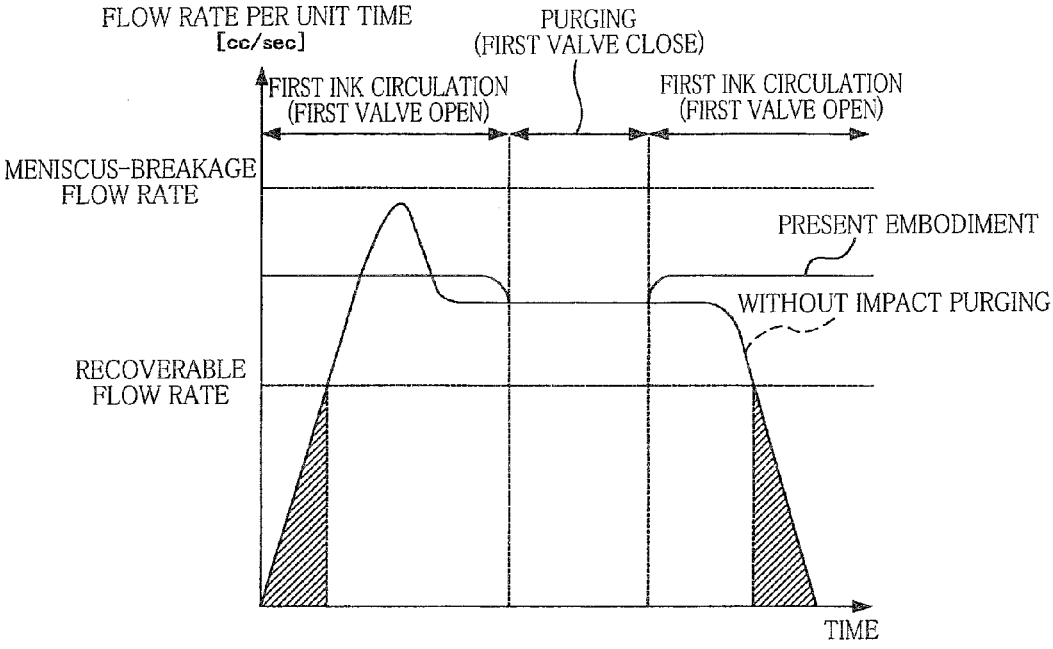
FIG. 10 is a graph showing a change in a flow rate of the ink that is supplied by the purge pump in a purge operation by the purging control portion shown in FIG. 6.

Referring next to FIGS. 8-10, the maintenance operation will be explained. The maintenance operation is for conducting maintenance of the ink-jet heads 1. The maintenance operation is initiated on occasions such as when the ink-jet printer 101 is turned on, when a standby time exceeds a predetermined time, and when a user inputs an instruction to initiate the maintenance operation. In both of an instance when the ink-jet printer 101 is in a standby state and an instance when the ink-jet printer 101 conducts the normal printing operation, the purge pump 86 is kept in an off state and the first and second valves 87, 88 are closed, as shown in FIG. 2. When the maintenance operation is initiated, a first circulation operation, a second circulation operation, a purging operation, and a wiping operation are carried out in the order of description. It is noted that the ink in the sub tank 80 can be supplied to the reservoir unit 71 through the ink supply tube 82 even when the purge pump 86 is kept in the off state.

In the first circulation operation, the head control portion 43 sends, to the actuator units 21, the meniscus-vibration signal for vibrating the ink meniscuses formed at all of the ejection openings 108, so that the meniscus at each ejection opening 108 is vibrated, resulting in an increase in the ink-meniscus breakdown pressure. As shown in FIG. 8A and FIG. 9, the circulation/purging control portion 44 drives the purge pump 86 after opening the first valve 87 and closing the second valve 88. Accordingly, the ink in the sub tank 80 is forcibly supplied into the ink inflow passage 72 through the ink supply tube 82. On this occasion, since the first valve 87 is open, a resistance against the ink flow in a route from the ink inflow passage 72 to the sub tank 80 via the first discharge passage 73 and the first return tube 83 is smaller than a resistance against the ink flow in a route from the ink inflow passage 72 to the ejection openings 108 via the ink outflow passages 75 and the manifolds 105. Therefore, the first ink circulation is conducted in which the ink supplied into the ink inflow passage 72 successively passes through the first discharge passage 73 and the first ink return tube 83 and finally returns back into the sub tank 80, without flowing into the ink outflow passages 75. By the first ink circulation described above, the air and the foreign substances remaining in the ink inflow passage 72, especially, the air and the foreign substances remaining on the filter 75*a*, pass, together with the ink, through the first discharge passage 73 and the first ink return tube 83 in order and are finally trapped in the sub tank 80.

When the first ink circulation is being conducted, the ink pressure in the ink inflow passage 72 and the first discharge passage 73 is higher than that when the printing operation is being conducted. Accordingly, the resin film 76 in the ink inflow passage 72 is brought into close contact with the limiting member 77 while the resin film 78 in the first discharge passage 73 is brought into close contact with the limiting member 79. After the first ink circulation has been conducted for a predetermined time, the circulation/purging control portion 44 stops driving of the purge pump 86 and thereafter closes the first valve 87. On this occasion, the circulation/purging control portion 44 increases the predetermined time during which the first ink circulation is conducted, in accordance with an increase in the temperature detected by a temperature sensor 35 configured to detect the ambient temperature of the ink-jet heads 1, and increases the predetermined time during which the first ink circulation is conducted, in accordance with an increase in the non-ejection time obtained by the non-ejection-time obtaining portion 46. Thereafter, the head control portion 43 stops sending of the meniscus-vibration signal to the actuator units 21. Thus, the first ink circulation operation is ended.

In the second circulation operation that is conducted following the first circulation operation, the head control portion 43 sends, to the actuator units 21, the meniscus-vibration signal for vibrating the ink meniscuses formed at all of the ejection openings 108. As shown in FIG. 8B and FIG. 9, the circulation/purging control portion 44 drives the purge pump 86 after closing the first valve 87 and opening the second valve 88. Accordingly, the ink in the sub tank 80 is forcibly supplied into the manifolds 105 via the ink supply tube 82, the ink inflow passage 72, and the ink outflow passages 75. On this occasion, since the second valve 88 is open, a resistance against the ink flow in a route from the manifolds 105 to the sub tank 80 via the second discharge passage 74 and the second ink return tube 84 is smaller than a resistance against the ink flow in a route from the manifolds 105 to the ejection openings 108 via the individual ink channels. Therefore, the second ink circulation is conducted in which the ink supplied into the manifolds 105 successively passes through the second discharge passage 74 and the second ink return tube 84 and finally returns back into the sub tank 80, without flowing into the individual ink channels. By the second ink circulation described above, the air and the foreign substances remaining in the ink outflow passages 75 and the manifolds 105 pass, together with the ink, through the second discharge passage 74 and the second ink return tube 84 in order and are finally trapped in the sub tank 80, without flowing into the individual ink channels.

When the second ink circulation is being conducted, the ink pressure in the ink inflow passage 72 is high, so that the resin film 76 in the ink inflow passage 72 is brought into close contact with the limiting member 77. After the second ink circulation has been conducted for a predetermined time, the circulation/purging control portion 44 stops driving of the purge pump 86 and thereafter closes the second valve 88. On this occasion, the circulation/purging control portion 44 increases the predetermined time during which the second ink circulation is conducted, in accordance with an increase in the temperature detected by the temperature sensor 35 and increases the predetermined time during which the second ink circulation is conducted, in accordance with an increase in the non-ejection time obtained by the non-ejection-time obtaining portion 46. Thereafter, the head control portion 43 stops sending of the meniscus-vibration signal to the actuator units 21. Thus, the second ink circulation operation is ended.

As shown in FIG. 10, for efficiently carrying the air and the foreign substances to the sub tank 80 in the first and second circulation operations described above, a flow rate, i.e., an amount of the ink that is supplied by the purge pump 86 per unit time, needs to be increased to such an extent that the flow rate is not larger than a meniscus-breakage flow rate that is a flow rate at which the ink meniscuses formed at the ejection openings 108 are broken, resulting in a leakage of the ink from the ejection openings 108. The meniscus-breakage flow rate is an actually measured value or a value calculated on the basis of the relationship between the height level of the ink-jet heads 1 and the height level of the sub tank 80 in the ink-jet printer 101, the viscosity of the ink, and so on. The value of the meniscus-breakage flow rate is stored in advance. As explained above, the breakdown pressure of the ink meniscuses at the ejection openings 108 is increased by vibrating the ink meniscuses at the ejection openings 108, in the first and second circulation operations. Accordingly, the flow rate of the ink that is supplied by the purge pump 86 can be more increased.

In the purging operation, the head control portion 43 sends, to the actuator units 21, the meniscus-vibration signal for vibrating the ink meniscuses formed at all of the ejection openings 108. As shown in FIGS. 9 and 10, the circulation/purging control portion 44 drives the purge pump 86 after opening the first valve 87 and closing the second valve 88, and conducts the first ink circulation. As a result, the ink pressure in the ink inflow passage 72 is increased. In the purging operation, the flow rate of the ink that is supplied by the purge pump 86 is set at a value that is less than the meniscus-breakage flow rate and that is not smaller than a recoverable flow rate which is a flow rate at which the air and the foreign substances remaining in the individual ink channels can be discharged together with the ink from the ejection openings 108 when the ink is later purged from the ejection openings 108. The value of the recoverable flow rate is an actually measured value and is stored in advance.

Subsequently, the circulation/purging control portion 44 closes the first valve 87 in a state in which the flow rate of the ink that is supplied by the purge pump 86 is kept stabilized at a value not smaller than the recoverable flow rate. Therefore, the ink supplied into the ink inflow passage 72 flows into the ink outflow passages 75 without flowing into the first discharge passage 73, successively passes through the manifolds 105 and the individual ink channels, and is finally discharged or purged from the ejection openings 108. The purged ink is received in a waste-ink tray.

The purging of the ink from the ejection openings 108 is initiated in a state in which the flow rate of the ink that is supplied by the purge pump 86 is kept stabilized at the value not smaller than the recoverable flow rate, so that the ink pressure in the ink inflow passage 72 is high immediately after the initiation of the purging. Accordingly, the thickened ink in the ejection openings 108 and the remaining air and foreign substances can be efficiently purged from the ejection openings 108. In contrast, in an arrangement in which such impact purging is not conducted, namely, in an arrangement in which the purge pump 86 is started to be driven with the first and second valves 87, 88 kept closed, for instance, the ink is wastefully purged from the ejection openings 108 until the flow rate of the ink that is supplied by the purge pump 86 reaches the recoverable flow rate.

After a predetermined amount of the ink has been purged from the ejection openings 108 by closing the first valve 87 for a predetermined time period, the circulation/purging control portion 44 restarts the first ink circulation by opening the first valve 87 and stops the purging from the ejection openings 108. In this instance, the predetermined amount of the ink purged from the ejection openings 108 is calculated on the basis of the flow rate of the ink that is supplied by the purge pump 86 and the predetermine time period during which the first valve 87 is closed.

The circulation/purging control portion 44 repeats closing and opening of the first valve 87 three times at prescribed time intervals, such that the predetermined amount of the ink is purged from the ejection openings 108 successively three times at the prescribed time intervals, with the purge pump 86 kept driven. In other words, the circulation/purging control portion 44 controls the first valve 87 such that a restricting operation of the first valve 87 in which an amount of the ink that passes therethrough is restricted and an opening operation of the first valve 87 in which the amount of the ink that passes therethrough is not restricted are repeated, while keeping the purge pump 86 driving. In this respect, the circulation/purging control portion 44 is configured to increase the predetermined time during which the first ink circulation is conducted and to increase a total purge amount of the ink purged from the ejection openings 108, in accordance with an increase in the temperature detected by the temperature sensor 35. Further, the circulation/purging control portion 44 is configured to increase the predetermined time during which the first ink circulation is conducted and to increase the total purge amount of the ink purged from the ejection openings 108 in the purging operation, in accordance with an increase in the non-ejection time obtained by the non-ejection-time obtaining portion 46. Thereafter, the circulation/purging control portion 44 stops driving of the purge pump 86. Thus, the purging operation is ended.

As explained above, the first circulation operation, the second circulation operation, and the purging operation are conducted in this order, whereby the air and the foreign substances remaining in the ink inflow passage 72, the manifolds 105, and the individual ink channels, respectively, can be directly discharged without being flowed into downstream-side passages thereof.

In the wiping operation conducted after the purging operation, the circulation/purging control portion 44 initially closes the first valve 87 and the second valve 88, whereby the ink attached to the ejection surfaces 2*a* as a result of the purging operation is prevented from being sucked back into the ejection openings 108. Subsequently, the maintenance control portion 45 controls a suitable moving mechanism to move the four ink-jet heads 1 upward and controls the moving device to move the wipers 32 in the main scanning direction along the respective ejection surfaces 2*a* while permitting the top end of each wiper 32 to be held in contact with the corresponding ejection surface 2*a*. According to the arrangement, the ink attached to the ejection surfaces 2*a* as a result of the purging operation is removed therefrom, and the condition of each of the ink meniscuses at the ejection openings 108 is made appropriate. After the ejection surfaces 2*a* have been wiped as described above, the wipers 32 and the ink-jet heads 1 are moved back to respective normal positions under the control of the maintenance control portion 45, and the circulation/purging control portion 44 opens the first valve 87 and the second valve 88. Thus, the wiping operation is ended.

According to the ink-jet printer 101 of the present embodiment, in the purging operation described above, the purging from the ejection openings 108 is initiated in a state in which the flow rate of the ink that is supplied by the purge pump 86 is kept stabilized at the value not smaller than the recoverable flow rate, so that the ink pressure in the ink inflow passage 72 is high immediately after the initiation of the purging. Accordingly, the thickened ink in the ejection openings 108 and the remaining air and foreign substances can be efficiently purged from the ejection openings 108. Therefore, the present arrangement can suppress wasteful consumption of the ink while enabling recovery of the ink ejection characteristics.

In the purging operation, only the first ink circulation is conducted prior to the purging from the ejection openings 108, so that there is not generated any ink flow in the manifolds 105 until just before the initiation of the purging, making it possible to suppress the pressure change or fluctuation in the manifolds 105. Accordingly, it is possible to give a uniform pressure to the individual ink channels at the time of initiation of the purging.

In the purging operation, the purging from the ejection openings 108 is stopped by opening the first valve 87. Thus, the purging of the ink from the ejection openings 108 can be quickly stopped, thereby more effectively suppressing wasteful consumption of the ink.

Moreover, in the purging operation, the closing and opening of the first valve 87 is repeated three times at the prescribed time intervals, such that the predetermined amount of the ink is purged from the ejection openings 108 successively three times at the prescribed time intervals, with the purge pump 86 kept driven. The arrangement permits the purging to be quickly conducted and quickly stopped. In other words, the ink in the ink inflow passage 72, the manifolds 105, and the individual ink channels can be efficiently vibrated at the prescribed time intervals, so that the thickened ink in the ejection openings 108 and the air and the foreign substances remaining in the ink passages can be efficiently purged from the ejection openings 108.

After the purging operation has been completed, the wiping operation is conducted with the first valve 87 and the second valve 88 kept closed. Accordingly, the ink purged from the ejection openings 108 is prevented from being sucked back into the ejection openings 108 due to a height difference between the ink-jet heads 1 and the sub tank 80, and the like.

In the present embodiment, the purge pump 86 is configured to function as the check valve. That is, the purge pump 86 functions as the backflow preventing device to prevent the ink from flowing to the sub tank 80 from the ink inflow passage 72. Accordingly, the first ink circulation and the second ink circulation can be conducted with high efficiency.

Since the maintenance operation includes the wiping operation described above, the ink and the foreign substances attaching to the ejection surfaces 2*a* can be removed while the condition of each of the ink meniscuses at the ejection openings 108 can be made appropriate.

The resin film 76 constitutes a part of the inner wall surface of the ink inflow passage 72 while the resin film 78 constitutes a part of the inner wall surface of the first discharge passage 73, so that the change or fluctuation of the ink pressure in the ink inflow passage 72 and the change or fluctuation of the ink pressure in the first discharge passage 73 can be efficiently suppressed by the deformation of the resin film 76 and the deformation of the resin film 78, respectively. Accordingly, the ink can be supplied to the individual ink channels while kept at a stabilized pressure. Further, when the ink is purged from the ejection openings 108, each of the resin films 76, 78 is kept stabilized in its deformed state. Accordingly, the thickened ink in the ejection openings 108 and the remaining air and foreign substances can be efficiently discharged.

When the resin films 76, 78 are deformed, the limiting members 77, 79 respectively prevent the resin films 76, 78 from protruding convexly toward the outside of the reservoir unit 71. According to the arrangement, the resin films 76, 78 are prevented from being broken due to excessive deformation thereof when the ink pressure in the ink inflow passage 72 and the ink pressure in the first discharge passage 73 become abnormally high. Further, in the first ink circulation of the purging operation, the limiting members 77, 79 respectively limit the deformation of the resin films 76, 78. Accordingly, even when the ink pressure in the ink inflow passage 72 increases by closing the first valve 87, the resin films 76, 78 are prevented from being further deformed. Therefore, the increased ink pressure can be propagated without any loss, so that the ink in the ink inflow passage 72 quickly flows into the individual ink channels, resulting in efficient purging of the ink from the ejection openings 108.

In the present embodiment, the flow rate, i.e., the amount of the ink that is supplied by the purge pump 86 per unit time, in the first ink circulation of the purging operation is made less than the meniscus-breakage flow rate. Accordingly, the ink is prevented from leaking from the ejection openings 108 in the first ink circulation, thereby suppressing wasteful consumption of the ink.

Because the purge pump 86 is the positive displacement pump, the ink can be supplied to the ink inflow passage 72 with high reliability without suffering from a backflow of the ink even when the ink pressure in the flow passages is high.

In the first circulation operation, the second circulation operation, and the purging operation, the ink meniscuses formed at the ejection openings 108 are vibrated under the control of the head control portion 43, whereby the meniscus-breakdown pressure is increased and the flow rate of the ink that is supplied by the purge pump 86 is accordingly increased. Accordingly, the ink can be discharged at a higher pressure from the ejection openings 108.

In the purging operation, the circulation/purging control portion 44 is configured to increase the predetermined time during which the first ink circulation is conducted and to increase the total purge amount of the ink purged from the ejection openings 108, in accordance with an increase in the ambient temperature of the ink-jet heads 1 detected by the temperature sensor 35. Further, the circulation/purging control portion 44 is configured to increase the predetermined time during which the first ink circulation is conducted and to increase the total purge amount of the ink purged from the ejection openings 108 in the purging operation, in accordance with an increase in the non-ejection time during which the ink droplets have not been ejected from the ejection openings 108, obtained by the non-ejection-time obtaining portion 46. Thus, the time during which the first ink circulation is conducted and the total purge amount of the ink to be purged are adjusted in accordance with the degree of the viscosity of the ink and the expected amount of the air and the foreign substances in the ink-jet heads 1, whereby the thickened ink in the ejection openings 108 and the remaining air and foreign substances can be efficiently discharged.

In the ink-jet printer 101 according to the present embodiment, the filter 75*a* is disposed so as to extend in the ink flow direction in the ink inflow passage 72. Accordingly, the resistance against the ink flow is large when the ink flows from the ink inflow passage 72 into the ink outflow passages 75 through the filter 75*a*. Therefore, the ink does not tend to flow into the ink outflow passages 75 in the first ink circulation, thereby restraining leakage of the ink from the ejection openings 108.

First Modified Embodiment

Figure 11:
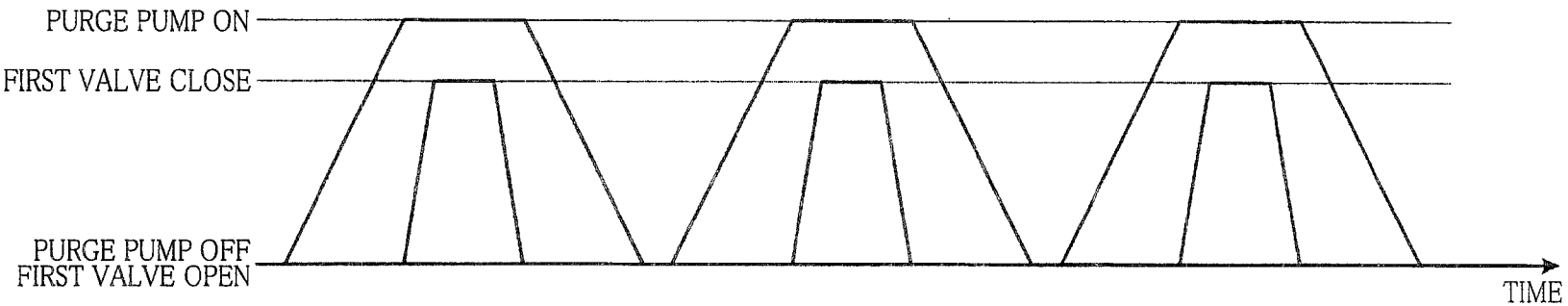
FIG. 11 is a view for explaining a first modified embodiment of the invention.

There will be next explained a first modified embodiment with reference to FIG. 11. In the illustrated embodiment, the circulation/purging control portion 44 is configured to repeat closing and opening of the first valve 87 three times at the prescribed time intervals, such that the predetermined amount of the ink is purged from the ejection openings 108 successively three times at the prescribed time intervals, with the purge pump 86 kept driven. As shown in FIG. 11, every time when the predetermined amount of the ink has been purged from the ejection openings 108 with the purge pump 86 driven, the purge pump 86 may be stopped from being driven. In other words, the stopping of driving of the purge pump 86 may be repeated three times at prescribed time intervals in accordance with the three times of purging.

Second Modified Embodiment

Figure 12:
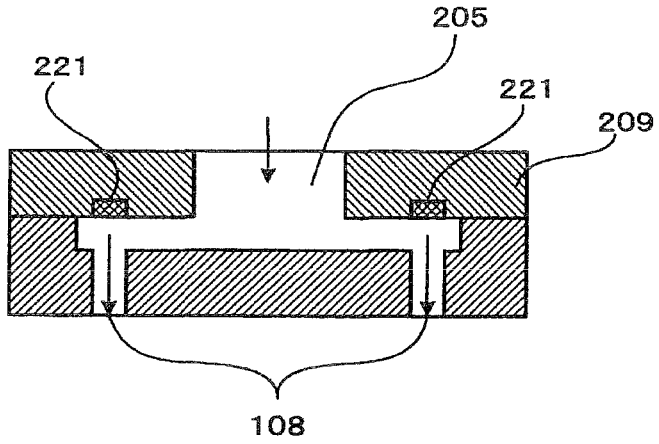
FIG. 12 is a view for explaining a second modified embodiment of the invention.

There will be next explained a second modified embodiment with reference to FIG. 12. In the illustrated embodiment, the head body 2 of each ink-jet head 1 has the unimorph actuators. The ink-jet head 1 may have a head body of other type. For instance, the ink-jet head 1 may have a thermal-type head body 209, as shown in FIG. 12. In the head body 209, a plurality of individual ink channels are branched from a common ink chamber 205, and there are disposed electric/thermal converting elements 221 each of which is opposed to a corresponding one of the ejection openings 108 of the respective individual ink channels. The ink droplets are ejected from the ejection openings 108 owing to thermal energy generated from the electric/thermal converting elements 221. According to the arrangement, the structure of the common ink chamber 205 and the structure of the individual ink channels can be simplified, so that the ink can be purged more efficiently from the ejection openings 108 in the purging operation described above.

While the preferred embodiment of the invention and the modified embodiments thereof have been described by reference to the accompanying drawings, it is to be understood that the invention is not limited to the details of those embodiments, but may be embodied with various changes and modifications, which may occur to those skilled in the art, without departing from the scope of the invention defined in the attached claims.

In the illustrated embodiments, the first circulation operation, the second circulation operation, the purging operation, and the wiping operation are conducted in this order in the maintenance operation. At least either one of the first circulation operation, the second circulation operation, and the wiping operation may not be conducted.

In the illustrated embodiments, the first ink circulation is conducted in the purging operation prior to the purging of the ink from the ejection openings 108. In place of the first ink circulation, the second ink circulation may be conducted prior to the purging of the ink. In this instance, the air and the foreign substances remaining in the manifolds 105 can be trapped in the sub tank 80 by the second circulation immediately before the initiation of the purging of the ink from the ejection openings 108. Accordingly, the air and the foreign substances remaining in the manifolds 105 can be prevented from flowing into the individual ink channels when the purging is conducted.

In the illustrated embodiments, the purging from the ejection openings 108 is stopped by opening the first valve 87 with the purge pump 86 kept driven, in the purging operation. The purging from the ejection openings 108 may be stopped by stopping driving of the purge pump 86 with the first valve 87 kept closed.

In the illustrated embodiments, the predetermined amount of the ink is purged from the ejection openings 108 successively three times at the prescribed time intervals. The purging may be conducted one time, two times, or four times or more. Further, the ink may be purged from the ejection openings 108 successively at arbitrary timing. Moreover, where the purging is conducted successively a plurality of times, the time period during which the first valve 87 is closed may be differed in each time when the purging is conducted such that the ink amount to be purged is differed in each time when the purging is conducted.

In the illustrated embodiments, the purge pump 86 is configured to function as the check valve. The purge pump 86 may be configured not to function as the check valve. In this instance, it is preferable to provide a check valve separately.

In the illustrated embodiments, the resin film 76 constitutes a part of the inner wall surface of the ink inflow passage 72 while the resin film 78 constitutes a part of the inner wall surface of the first discharge passage 73. The reservoir unit 71 may be configured not to have at least either one of the resin films 76, 78.

In the illustrated embodiments, the limiting members 77, 79 are configured to respectively limit the protruding deformation of the resin films 76, 78 convexly toward the outside of the reservoir unit 71. At least either one of the resin films 76, 78 may not be fixed to the reservoir unit 71.

In the illustrated embodiments, the flow rate of the ink that is supplied by the purge pump 86 in the first ink circulation of the purging operation is made less than the meniscus-breakage flow rate. In an instance where the amount of the ink to leak from the ejection openings 108 in that first ink circulation is small, the flow rate of the ink that is supplied by the purge pump 86 may be not smaller than the meniscus-breakage flow rate.

In the illustrated embodiments, the purge pump 86 is the positive displacement pump of the three-phase diaphragm type. The purge pump 86 may be a positive displacement pump of the other type such as a tube pump type. The purge pump 86 may be other than the positive displacement pump, such as an impeller type pump.

In the illustrated embodiments, the ink meniscuses at the ejection openings 108 are vibrated in the first circulation operation, the second circulation operation, and the purging operation. The ink meniscuses may not be vibrated in at least either one of those operations. In this instance, since the meniscus-breakage flow rate is lowered, it is preferable that the flow rate of the ink that is supplied by the purge pump 86 be made less than the lowered meniscus-breakage flow rate.

In the illustrated embodiments, the circulation/purging control portion 44 is configured to increase the predetermined time during which the first ink circulation is conducted and to increase the total purge amount of the ink purged from the ejection openings 108, in accordance with an increase in the ambient temperature of the ink-jet heads 1 detected by the temperature sensor 35. Further, the circulation/purging control portion 44 is configured to increase the predetermined time during which the first ink circulation is conducted and to increase the total purge amount of the ink purged from the ejection openings 108 in the purging operation, in accordance with an increase in the non-ejection time during which the ink droplets have not been ejected from the ejection openings 108, obtained by the non-ejection-time obtaining portion 46. The circulation/purging control portion 44 may be configured to determine at least either one of the predetermined time during which the first ink circulation is conducted and the total purge amount of the ink purged from the ejection openings 108, on the basis of only one of the ambient temperature of the ink-jet heads 1 and the non-ejection time. Alternatively, the time during which the first ink circulation is conducted and the total purge amount of the ink purged from the ejection openings 108 may be respective fixed values determined in advance.

In the illustrated embodiments, each ink-jet head 1 and each ink supply unit 10 have a flow-passage structure in which the first circulation and the second circulation can be conducted. The ink-jet head 1 and the ink supply unit 10 may have a flow-passage structure in which only one of the first circulation and the second circulation can be conducted.

It is to be understood that the principle of the invention is applicable to a recording apparatus configured to eject a liquid other than the ink. It is further to be understood that the principle of the invention is applicable to a facsimile machine and a copying machine other than the printer.

What is claimed is:

1. A liquid ejecting apparatus, comprising:

a tank for storing a liquid;

a liquid ejecting head including: an inner passage having an inlet and an outlet; and a plurality of individual liquid channels extending from the inner passage to respective ejection openings;

a supply passage which connects the tank and the inlet;

a return passage which connects the tank and the outlet;

a supply device configured to forcibly supply the liquid in the tank to the inner passage;

a restrictor valve configured to restrict an amount of the liquid that flows through the return passage; and a discharge controller configured to drive the supply device while placing the restrictor valve in an open state, such that liquid circulation is conducted in which the liquid in the tank returns back thereto via the supply passage, the inner passage, and the return passage, in order, and configured to control the restrictor valve to restrict, during the liquid circulation, the amount of the liquid that flows through the return passage, for permitting a discharge of the liquid from the ejection openings, in a state in which the supply device is kept driven, wherein the inner passage has a first liquid circulation path which does not pass a vicinity of the plurality of individual channels and a second liquid circulation path which passes the vicinity of the plurality of individual channels, and wherein the liquid is discharged from the ejection openings during the liquid circulation in the second liquid circulation path.

2. The liquid ejecting apparatus according to claim 1, wherein the discharge controller is configured to place the restrictor valve in the open state so as to stop the discharge of the liquid from the ejection openings.

3. The liquid ejecting apparatus according to claim 2, wherein the discharge controller is configured to control the restrictor valve such that a restricting operation of the restrictor valve in which an amount of the liquid that passes therethrough is restricted and an opening operation of the restrictor valve in which the amount of the liquid that passes therethrough is not restricted are repeated a plurality of times, while keeping the supply device driving.

4. The liquid ejecting apparatus according to claim 2, wherein the discharge controller is configured to place the restrictor valve in a closed state after the restrictor valve has been opened and the supply device has been ceased to be driven.

5. The liquid ejecting apparatus according to claim 4, further comprising a backflow preventing device disposed in the supply passage so as to prevent the liquid from flowing to the tank from the inner passage.

6. The liquid ejecting apparatus according to claim 4, further comprising a wiping device configured to wipe an ejection surface in which the ejection openings are formed, in a period in which the restrictor valve is kept closed after the supply device has been ceased to be driven.

7. The liquid ejecting apparatus according to claim 1, wherein at least a part of an inner wall surface of a flow passage constituted by the inner passage, the supply passage, and the return passage is formed by a member having flexibility.

8. The liquid ejecting apparatus according to claim 7, further comprising a limiting member configured to limit deformation of the member having flexibility by an amount larger than a prescribed amount in a direction in which the flow passage expands.

9. The liquid ejecting apparatus according to claim 1, wherein a flow rate of the liquid that is supplied by the supply device in the liquid circulation is set such that the liquid is not discharged from the ejection openings even when the restrictor valve is placed in the open state.

10. The liquid ejecting apparatus according to claim 1, wherein the supply device is a positive displacement pump.

11. The liquid ejecting apparatus according to claim 1, wherein the liquid ejecting head further includes a vibration-energy giving device configured to generate vibration energy by which meniscuses formed at the respective ejection openings are vibrated, and wherein the liquid ejecting apparatus further comprises a meniscus-vibration controller configured to drive the vibration-energy giving device when the liquid circulation is being conducted.

12. The liquid ejecting apparatus according to claim 1, further comprising an ambient-temperature sensor configured to detect an ambient temperature of the liquid ejecting head, wherein the discharge controller is configured to change at least one of a time during which the liquid circulation is conducted and an amount of the liquid discharged from the ejection openings, on the basis of the ambient temperature detected by the ambient-temperature sensor.

13. The liquid ejecting apparatus according to claim 1, further comprising a non-ejection-time obtainer configured to obtain a non-ejection time during which the liquid has not been ejected from the ejection openings, wherein the discharge controller is configured to change at least one of a time during which the liquid circulation is conducted and an amount of the liquid discharged from the ejection openings, on the basis of the non-ejection time obtained by the non-ejection-time obtainer.

14. The liquid ejecting apparatus according to claim 1, wherein the discharge controller is configured to control the restrictor valve in a state in which a flow rate of the liquid that is supplied by the supply device is kept stabilized by driving of the supply device.

15. The liquid ejecting apparatus according to claim 1, wherein the liquid circulation in the first liquid circulation path is conducted before the liquid is discharged from the ejection openings during the liquid circulation in the second liquid circulation path.

16. The liquid ejecting apparatus according to claim 1, wherein a filter is provided between the first liquid circulation path and the second liquid circulation path.

* * * * *